United States Patent [19]

Oleson et al.

[11] Patent Number: 4,944,647

[45] Date of Patent: Jul. 31, 1990

[54] BOTTLE CUTTING AND EMPTYING MACHINE

[75] Inventors: John C. Oleson, South Pasadena; Steven K. Teske, Moreno Valley; Richard F. Iturzaeta, Moorpark; Erwin E. Langer, Rancho Cucamonga, all of Calif.

[73] Assignee: Alpha Therapeutic Corporation, Los Angeles, Calif.

[21] Appl. No.: 187,818

[22] Filed: Apr. 29, 1988

[51] Int. Cl.[5] ..... B65B 3/04

[52] U.S. Cl. ..... 414/412; 414/418; 414/411; 198/417; 198/625

[58] Field of Search ..... 198/417, 625; 414/403, 414/404, 411, 412, 418

[56] References Cited

U.S. PATENT DOCUMENTS

| | | | |
|---|---|---|---|
| 3,189,159 | 6/1965 | Shields | 414/418 X |
| 3,591,027 | 7/1971 | East | 414/418 |
| 3,651,751 | 3/1972 | Randrup | 414/411 X |
| 3,659,717 | 5/1972 | Bourbina | 414/418 X |
| 3,729,108 | 4/1973 | Rice | 414/418 X |
| 3,889,442 | 6/1975 | Grahn et al. | 414/412 X |
| 3,939,623 | 2/1976 | Shine et al. | 414/412 X |
| 4,104,081 | 8/1978 | Totten | 198/417 X |
| 4,690,267 | 9/1987 | Gradoboev et al. | 198/625 X |

FOREIGN PATENT DOCUMENTS

| | | | |
|---|---|---|---|
| 2919488 | 11/1980 | Fed. Rep. of Germany | 198/625 |
| 2573054 | 5/1986 | France | 198/625 |

*Primary Examiner*—Frank E. Werner

*Attorney, Agent, or Firm*—Christie, Parker & Hale

[57] ABSTRACT

A high capacity machine cuts the tops of plastic bottles and inverts the bottles for discharging their contents. Bottles are conveyed through the machine by a feed screw. At the cutting station means are provided for standing the bottles erect so that they engage a stationary knife just below the top for cutting off the caps. Guides downstream from the cutting station maintain the bottle in the screw and invert it underneath the screw for dumping. The cap is not completely severed but a minor portion of the circumference is left intact to serve as a hinge between the cut bottle and cap. The cap is kept more or less erect as the bottle is inverted to avoid interference with discharge of the contents. At the cutting station a support screw is rotated synchronously with the feed screw by interengaging teeth on the crests of the threads of the two screws.

25 Claims, 6 Drawing Sheets

BOTTLE CUTTING AND EMPTYING MACHINE

BACKGROUND OF THE INVENTION

This invention concerns a machine for cutting the top of plastic bottles and inverting them for discharging the contents.

There are times when it is desirable to empty the contents of bottles with a high production rate. An example of this is the emptying of bottles of blood plasma which is pooled for extraction of medically useful fractions. Processing of many thousands of liters per day is commonplace. Fresh blood plasma is often sealed in polyethylene or polypropylene bottles and frozen. The plasma in such bottles is thawed and thousands of such bottles are opened and emptied to provide a pool of plasma for extractions.

With such medical material it is important to maintain a reasonably sterile environment to minimize microbial contamination. Thorough draining of the emptied bottles is desirable so as not to waste this precious commodity.

A previous machine for opening such bottles was in the form of a carousel. Two bottles at a time were loaded into bottle carriers on the carousel and indexed to a cutting station where rotating cutters cut the sides of the bottles near the top so the cap could be removed. The caps were withdrawn by pneumatic suction. When the caps were removed, the bottles were indexed to the next station where the bottle carriers and bottles were inverted for discharging their contents. The bottles were then progressively indexed around the carousel in the inverted position for draining the last of the contents. At the final station an air blast ejected the emptied bottles to a conveyer.

The carousel bottle opening machine occupied a large amount of floor space, and primarily because of the pneumatics, was extremely noisy. Noise levels as high as 110 db were observed. Although such a machine was designed for a production rate of 38 bottles per minute, the actual yield was in the order of 22 to 24 bottles per minute because of stoppages due to the mechanical complexity of the apparatus. The mechanical complexity also contributed to difficulty in maintaining a low level of microbial contamination. Contamination levels in excess of 100 colony forming units per milliliter were usually observed.

Blood plasma is frozen in bottles having some variation in height and cross section. Although the bottles from different manufacturers have height differences of only about 15 millimeters, many changes in the machine set-up were required to handle the different sized bottles. More than twenty different parts of the machine needed to be changed in order to accommodate a different bottle size. Such mechanical complexity leads to significant maintenance time, as well as time for cleaning the apparatus for minimizing microbial contamination.

Although the individual blades for the rotary cutters are relatively inexpensive, they will cut only about three thousand bottles before they needed replacing. For such reasons it was well recognized that a totally different type of bottle opening and emptying machine was desirable.

Such a machine should have a minimum number of moving parts for reliability and ease of cleaning. Concomitantly that should result in a low level of microbial contamination. The effective through put of the machine should be high, which is a consequence of a high production rate and high yield due to inherent reliability. The bottles passing through such a machine must be cut cleanly so that the caps are reliably removed and prevented form interfering with the emptying of the contents of the bottles.

Mechanical handling arrangements are preferred over pneumatics so that reasonable noise levels can be maintained. It is also desirable to have continuous operation rather than the indexing employed in the carousel-type machine.

BRIEF SUMMARY OF THE INVENTION

There is therefore provided in practice of this invention according to a presently preferred embodiment a machine for cutting and emptying plastic bottles which are conveyed through the machine by a feed screw. Means are provided so that bottles which tend to tip within the screw are stood erect before they encounter a stationary knife aligned just below the top of the bottles for cutting off the caps. The blade of the knife is asymmetrical for cutting a major part of the circumference of the bottle to leave a minor part connecting the cap with the balance of the bottle along one side. As the cut bottle moves downstream from the knife, it is inverted by tilting downwardly and beneath the axis of the screw for discharging the contents of the bottle into a collection launder. Meanwhile, the cap is held more or less erect so as not to interfere with discharge of the contents. The bottle is maintained inverted for recovering drainage, and finally discharged from the machine.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Figure 1:
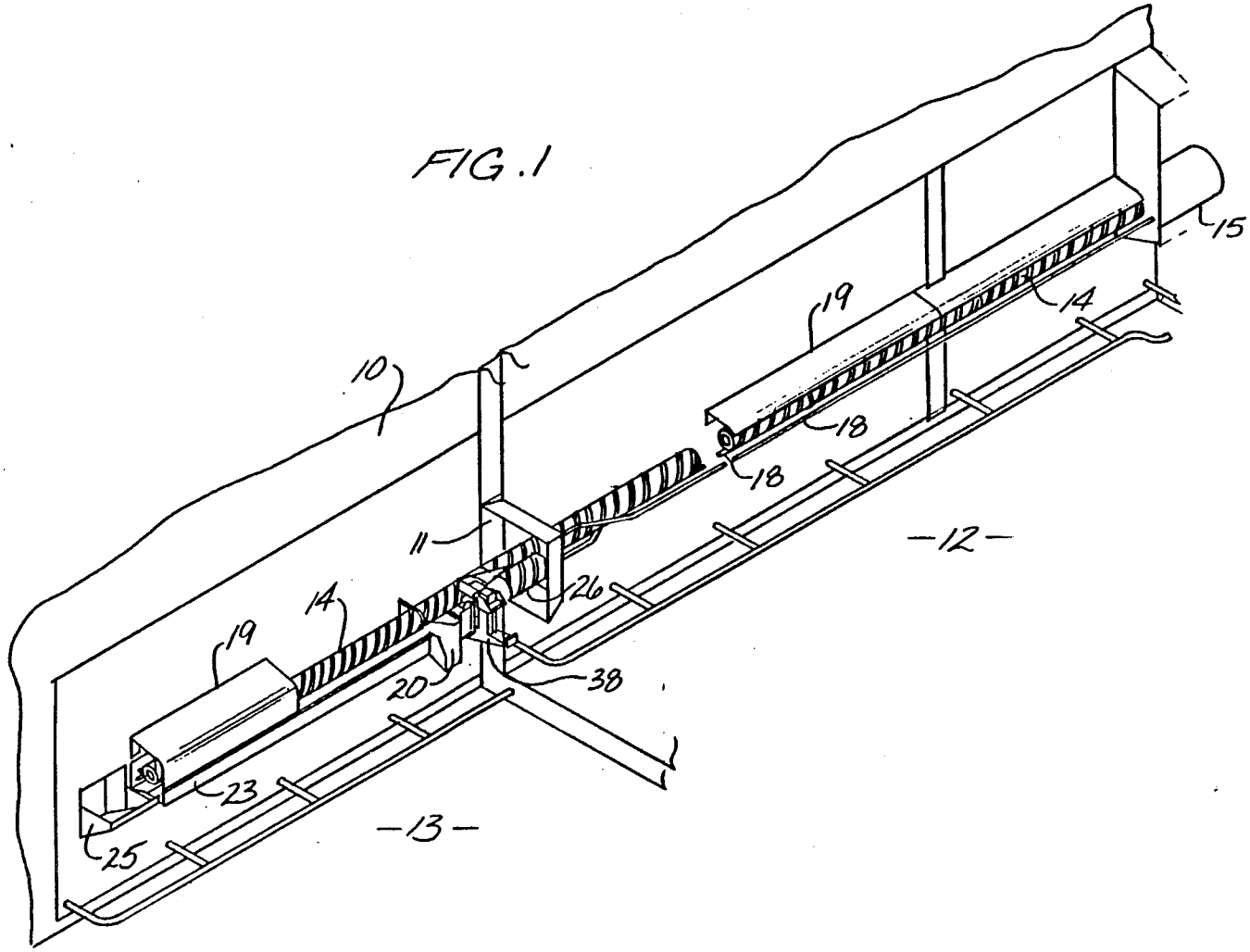
FIG. 1 is an overall isometric semi-schematic view of a bottle cutting and emptying machine constructed according to principles of this invention.
Figure 2:
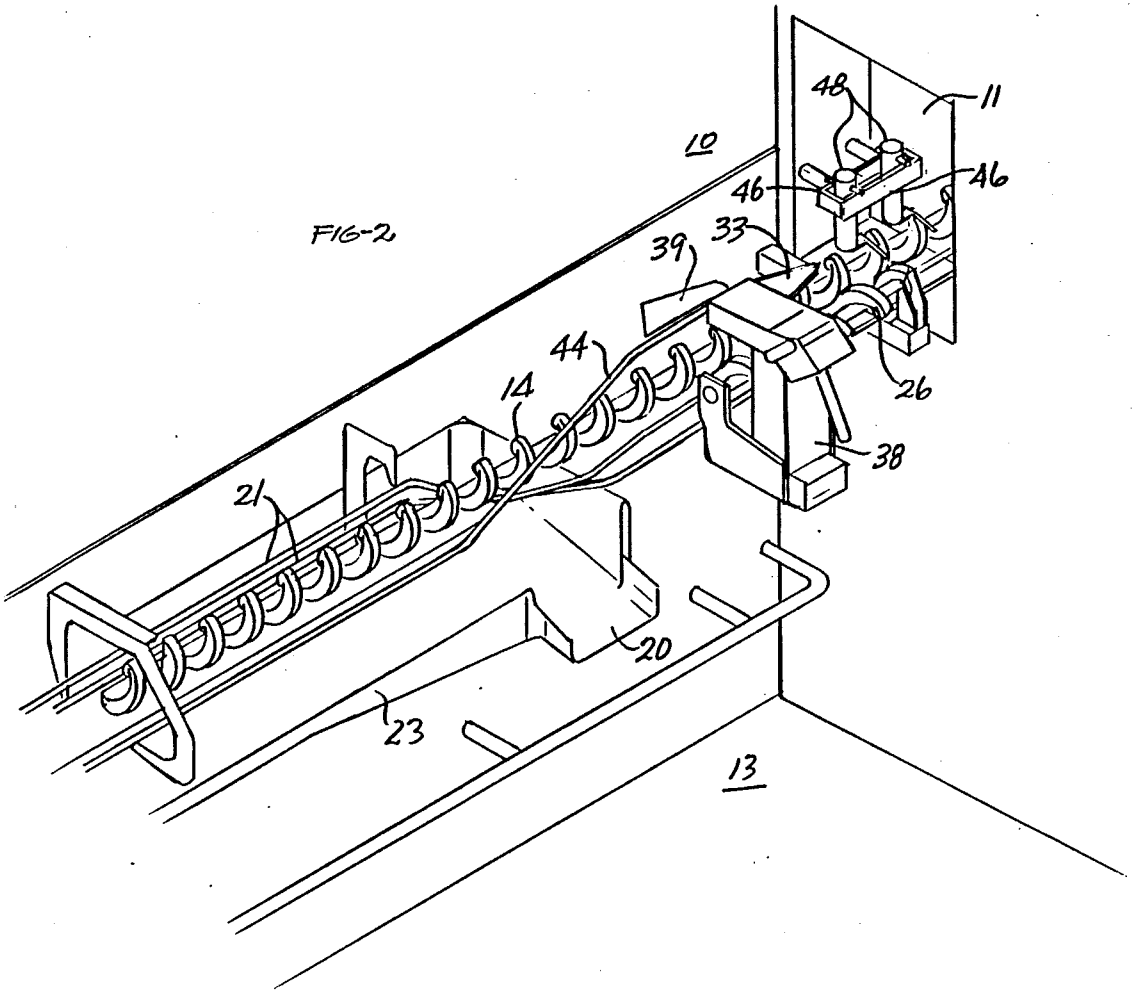
FIG. 2 is a similar isometric view somewhat enlarged illustrating additional details of the cutting and inverting sections of the machine.

A typical bottle cutting and emptying machine constructed according to principles of this invention can be mounted along a wall 10, leaving the balance of the room available for other purposes. In the illustrated embodiment the machine extends through a window-like "pass-through" 11 through a wall separating a thawing room 12 from a processing room 13. Racks of bottles of frozen blood plasma are kept in the thawing room so that a major portion of the plasma is melted for ease of discharge. Some cores of ice may remain without interfering with operation of the machine.

The machine has an elongated horizontal feed screw 14 extending the full length of the machine. The feed screw is rotated by a variable speed electric motor 15. For typical operation for emptying plasma bottles, the rotation speed is in the range of from 20 to 60 RPM. At top speed such an apparatus processes up to 60 bottles of plasma per minute. It is found that an effective yield of at least 50 bottles per minute can be provided since the simplicity of the apparatus means that there is very little down time.

Although of a unique configuration for this application, feed screws for conveying articles such as bottles are conventional. The screw has a stainless steel core 16 (FIG. 3) for stiffening and supporting a surrounding polyethylene body. The thread on the screw is machined into the polyethylene to the desired shape. Such a screw may be assembled of several shorter sections of polyethylene screw fastened onto a long stainless steel core. In an exemplary embodiment the diameter of the screw at the root of the thread is about six centimeters. This dimension and the shape of the thread root remain uniform throughout the length of the feed screw. As mentioned hereinafter, the pitch of the screw and the thread crest diameter vary along the length of the screw.

In a principal portion of its length, the root 17 of the thread on the feed screw has a radius to fit the radius of a bottle to be handled by the machine when standing erect; that is, perpendicular to the axis of the screw. The root of the thread is shaped so that it conforms to a vertical cylinder having a diameter of 8.38 centimeters which approximates the diameter of the largest blood plasma bottles commonly used. Somewhat smaller diameter and slightly oval bottles can be accommodated and processed in the "pockets" formed with such a thread geometry.

In the thawing room 12 a pair of upstream guide bars 18 extend along the length of the screw. The guide bars serve to close the bottom and one side of a continuous row of moving "pockets", one-half of which is defined by the thread on the screw. Bottles are manually placed in the successive moving pockets in the thawing room. One of the upstream guide bars supports the bottom of the bottles and the other supports the side. That is the only support needed.

In the thawing room the guide bars are arranged so that the axis of the bottle is tilted at about 45° from the vertical for convenience in loading. The guide bars 18 follow a generally helical path near the pass-through 11 through the wall between the thawing and processing rooms to guide the bottles into a vertically erect orientation.

Transparent plastic guards 19 extend over the screw for protection and cleanliness. It will be noted that some of the guards are deleted in FIG. 1 to better show the apparatus.

Figure 5:
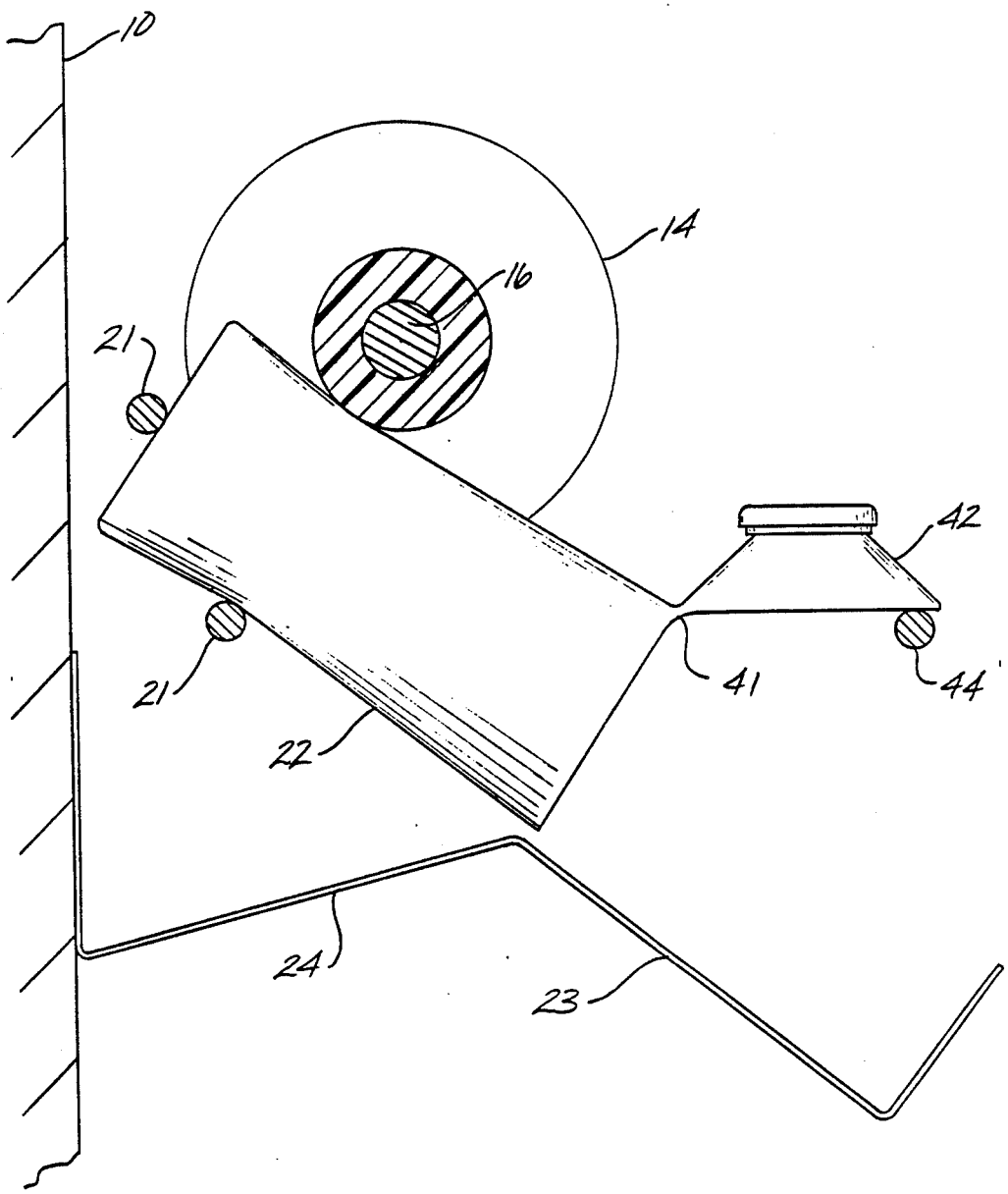
FIG. 5 is a transverse cross section at a portion of the machine where the bottles are inverted for draining their contents.

Immediately downstream from the pass-through into the processing room there is a cutting station where the top of the bottle is cut for removing the cap. Downstream from the cutting station, guide bars 21 for guiding the bottom and side of a bottle follow a generally helical path around the axis of the screw for tilting the bottle downwardly so that it rotates under the axis of the screw. This continues until the bottle 22 is inverted about 35° from the horizontal as illustrated in FIG. 5. The contents of the bottle are discharged into a launder 20 from which they dump into other processing apparatus (not shown).

The downstream guide bars 21 then extend horizontally to retain the bottle inverted with only its open mouth overlying a drain trough 23 which catches drainage from the bottles. A principal portion of the length of the bottle overlies a catch tray 24 so that any debris from the exterior of the bottle will not commingle with the contents.

At the downstream end of the machine the bottles fall from the end of the screw into a chute 25 which leads to a grinder which grinds the emptied bottles into chips.

The pitch of the screw is about 10.5 centimeters in the thawing room so that the pockets along the thread of the screw move at a convenient rate for hand loading. In the portion of the screw extending through the cutting and inverting stations the pitch is about 13.5 centimeters. A larger pitch is used to provide sufficient material for strength of the screw in a larger diameter portion 44 employed in this part of its length, and for gear teeth hereinafter described. The pitch returns to about 10.5 centimeters downstream from the inversion station so that bottles move more slowly along the drainage trough to provide additional time for plasma to drain from the bottles. This is not a trivial change. In the prior carousel the drain time for the bottles was about twelve seconds. Due to slow travel over a long drainage path, the drain time when the machine is operating at 40 bottles per minute is increased to 38 seconds. This manifests itself in an increased recovery of over 200 kilograms of plasma per week.

A smooth transition is made in the pitch and in the crest diameter of the thread where changes are made so that the bottles move smoothly through the apparatus.

Figure 3:
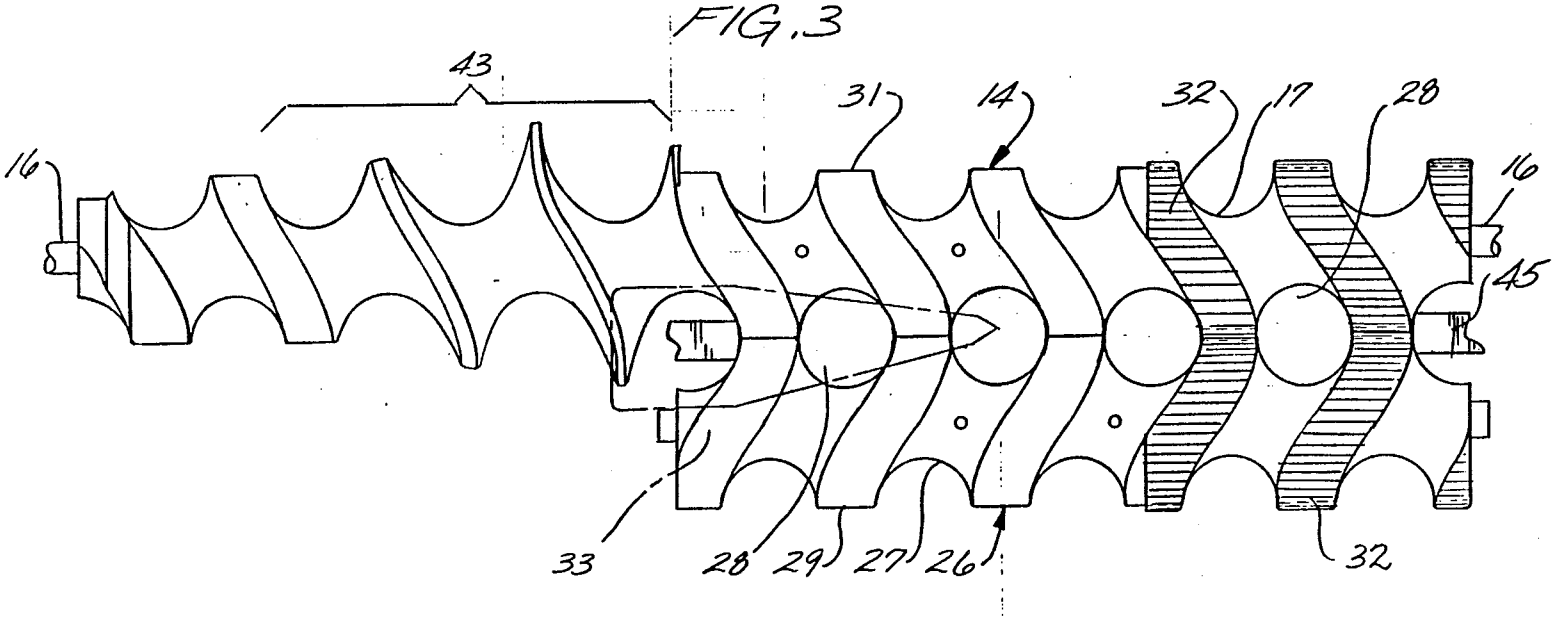
FIG. 3 is a top view of a portion of screws for conveying bottles through the cutting and inverting portions of the machine.

FIG. 3 illustrates in top view the portion of the feed screw 14 extending through the cutting and inverting portions of the apparatus. Most of the other parts of the apparatus have been deleted from this drawing for clarity. In the cutting station a support screw 26 is mounted for rotation parallel to the feed screw. The feed screw has a right hand thread and the support screw has a left hand thread. The root 27 of the support screw thread has the same shape as the root 17 of the feed screw thread. Collectively the roots of the two threads define a circular pocket 28 between the screws which accommodates and closely surrounds a vertical bottle having a diameter of 8.38 centimeters.

The crest 29 of the support screw thread touches or nearly touches the crest 31 of the feed screw thread. A very small clearance between the crests of the threads has been found to be important to prevent jamming in the cutting station. When the top is cut off a plastic bottle, it loses considerable rigidity and the upper portion of the bottle may collapse under side loads.

It has been found that if the clearance between the crests of the threads is more than one wall thickness of the bottles, occasional bottles may pinch into the clearance and cause jamming. If the clearance is as much as two wall thicknesses many bottles will extrude into the clearance and cause jamming An exemplary wall thickness on a plastic bottle for blood plasma is about 0.75 millimeter. Thus, the clearance should be less than 0.75 millimeter and is preferably zero or nearly zero. The clearance is sufficiently critical that bearings mounting the support screw are changed monthly to avoid the effect of accumulated wear.

The support screw rotates synchronously with the feed screw. To avoid the complication of maintaining a separate drive for the support screw in synchronism with the variable drive speed of the feed screw, the feed screw is used to drive the support screw. An ordinary gear cannot be used since bottles could not pass a gear in the middle of the feed screw. Gear teeth 32 are, therefore, cut on the crests of the threads on the feed screw and support screw along two pitch lengths at the upstream end of each of the screws. The thread crest diameters are slightly enlarged from the close clearance portion of the screws so that the pitch diameter of the interengaging gear teeth is about the same as the crest diameters in the close clearance section. The interengaging gear teeth provide the drive for the support screw and maintain the two screws in synchronism. The teeth are omitted in the close clearance section since they might otherwise exacerbate jamming.

Figure 4:
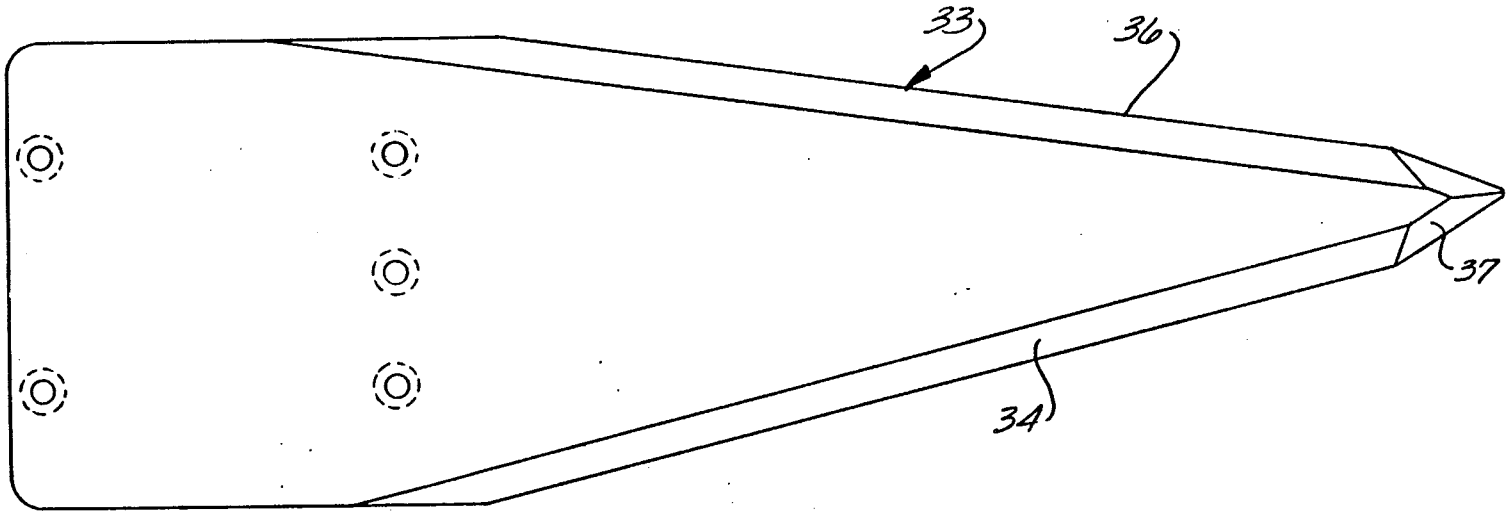
FIG. 4 is a top view of a representative knife for cutting plastic bottles.

A stationary horizontal cutting knife, illustrated in phantom in FIG. 3 and in greater detail in FIG. 4, is located as close above the top of the close clearance part of the thread crests as is feasible. The cutting knife has a bifacial, hardened stainless steel blade having a front cutting edge 34 and a back cutting edge 36. Each of the back and front cutting edges is symmetrically ground to a sharp edge at an angle of 12°; that is the included angle of the cutting edge is 24°. A symmetrical grind is used to form the cutting edges so that as the bottle is moved along the length of the knife, there is a symmetrical force which neither depresses nor elevates the bottle.

A V-shaped piercing tip 37 is ground on the pointed upstream end of the knife. Each cutting face of the V-shaped tip is symmetrically ground at an angle of 17° so that the included angle of the piercing tip is 34° . It has been found that a short and somewhat blunt piercing tip is important for commencing the cut on the bottle, whereas somewhat sharper front and back cutting edges are employed downstream from the piercing tip for continuing the cut initiated by the tip. A short, stiff tip is used to avoid deflection of the tip which could damage the knife. A blunt tip is acceptable since the top on the bottle at the time of piercing provides stiffness for resisting collapse of the bottle. Once past the tip, it is desirable to have a sharper edge on the blade for minimizing forces tending to deform the bottle, which by this time is largely severed from the cap and more flexible.

Some criticality has been found in the geometry of the cutting knife. A blade thickness of more than three millimeters has been found necessary to provide adequate stiffness to prevent deflection of the cutting blade. Deflection during cutting can be a significant problem since forces increase on a deflected blade and may cause breakage or damage to the feed and support screws. However, a relatively thick blade may apply excessive side loads on a bottle which may cause the bottle to collapse, particularly when the cap is largely severed so that its strengthening rigidity is lost. Thus, a blunt piercing tip and a small included angle on the front and back cutting edges and small rake angles of the front and back cutting edges are significant.

The rake angles of the back and front cutting edges are preferably in the range of from 5 to 20° from the longitudinal axis of the blade. As is clear from FIG. 4 the blade is asymmetrical and in an exemplary embodiment the back cutting edge 36 is at an angle of about 8° from the longitudinal axis of the blade while the front cutting edge is at an angle of about 15 from the blade axis. An included angle between the two cutting edges of the V-shaped piercing tip in the order of 55 to 60° has been found suitable. These edges are ground to meet the front and back cutting edges.

Although a blade for the new bottle cutting machine is more costly than the rotating blades previously used, it have a lifetime of at least fifty times the previous blades. Further, after cutting about 150,000 bottles, the blade can be reground for sharpening and reused. A blade can be reground several times before it can no longer be used.

The cutting blade is asymmetrical since it is desired to cut a major portion of the circumference of the bottle, leaving a minor portion connecting the cap and bottle so that loose caps need not be handled. The piercing tip of the blade preferably contacts the cylindrical surface of the bottle near its center for reliably piercing the bottle without applying a substantial load transverse to the screws. As seen in FIG. 3, the tip of the knife is not exactly on the center line over the screws, but it is offset toward the back of the apparatus; that is toward the wall. It has been found important that the piercing tip is offset from the center line over the screws to minimize forces tending to squeeze the edge of the bottle into the clearance between the screws.

As the bottle moves under the knife, the front cutting edge shears the top of the bottle until the entire front is severed. Meanwhile the back cutting edge slices toward the back of the bottle The position of the knife laterally over the top of the screws is fixed so that the back of the bottle can pass behind the back edge of the blade and not be cut. It is desirable to cut about 90% of the circumference of the bottle, leaving about 10% of the circumference at the back to act as a hinge connection between the severed cap and the balance of the bottle.

The rigid structure 38 for mounting the blade of the cutting knife 33 is in front of and over the cutting station, and is essentially flat on the inside to clear the tops of the crests on the threads of the screws and clear the top of the cut bottles which pass beneath the knife. On the top of the mounting structure just downstream from the back edge of the knife, there is a vertical fin 39 which fits under the mostly severed cap, causing it to form a hinge 41 between the bottle and its cap 42.

The thickness of the knife and its support begins opening of a gap between the partially severed cap and the remainder of the bottle. As the cap is raised there is a tendency toward buckling of the bottle along the relatively stiff uncut portion which is an arc instead of a straight line. The fin rotates the cap upwardly while the bottle is still captive in the pocket between the screws, far enough that the polyethylene or polypropylene at the hinge line plastically deforms and forms a flexible, straight hinge line. Once the hinge line is formed by sharply bending the cap away from the bottle, the stiffness of the connection between the cap and bottle is significantly reduced, and maintaining the gap between the cap and bottle as the contents are discharged is simplified.

Meanwhile the largely severed bottle enters an enlarged portion 43 of the feed screw immediately downstream from the cutting station and the downstream end of the support screw. The enlarged portion of the screw, which has a thread crest diameter of as much as 23 centimeters, provides support for the bottle as it is pivoted to an inverted position for discharging its contents. The enlarged thread crest helps support the lower portion of the bottle as it comes out of the pockets 28 between the feed screw and support screw. It is desirable to increase the crest diameter for guiding the bottle since the guide bars downstream from the knife preferably invert the bottle rapidly to minimize liquid contact with the exterior of the bottle, which may not be as sterile as the contents.

The bottom of the bottle is on an upstream guide bar 18 as it approaches the cutting station. It slides onto a downwardly tilted adjustable height guide rail 45 extending longitudinally beneath the bottom of the bottle through the cutting station The adjustable height accommodates bottles of differing heights and comprises the only changeable part for changing the machine from one size bottle to another. It is found, however, that the machine operates satisfactorily without such changing, even with bottle height variations of as much as fifteen millimeters. Surprisingly, bottles of mixed heights and diameters from various manufacturers can be commingled and processed together without difficulty. This was completely impossible with the carousel machine.

The lower guide rail 45 supports the bottle at an elevation such that the blade of the knife intersects the side of the bottle just below the top. Before the cap is separated, this portion of the bottle is considerably stiffer than portions near the middle of the bottle, for example. Thus, it is desirable to pierce the bottle near the top. The exact dimension is not critical, however, as indicated by the ability of the machine to handle bottles of differing heights.

When the cap is partially severed from the bottle, the bottle is supported by the cap and the bottom of the bottle may lift off of the downwardly sloping lower guide rail. The bottle drops back to the lower guide rail (if separated) when the lid is pivoted up by the fin 39 or passes beyond the downstream end of the fin. By this time the stiffer bottom of the bottle can be supported by the enlarged thread crest on the feed screw as the bottle is inverted.

The guide bars 21 downstream from the cutting station follow a generally helical path around the screw and gradually come closer to the axis of the screw as the enlarged thread crest decreases in diameter in the downstream direction. The rotation of the feed screw and the weight of the plasma in the bottle tend to rotate it downwardly and the guide bars beneath and on one side of the bottle permit it to tilt forwardly and spill the contents into the collection launder.

Meanwhile, the downstream guide bar 21 that engages the side of the bottle approaches close enough to the axis of the screw to slightly pinch the collapsible side of the bottle (as can be seen in FIG. 5). This pinching grips the bottle between the guide bar and the root of the screw thread as the bottle is inverted for draining the last liquid into the drain trough. The cap meanwhile has passed beyond the downstream end of the fin and flops down onto a cap rail 44 which slopes downwardly through the inversion section and then extends horizontally along with the downstream guide bars 21 through the drainage section of the apparatus. The cap rail keeps the cap pivoted away from the open mouth of the bottle, maintaining the gap between the severed top and the balance of the bottle so that the top does not interfere with drainage of the contents.

Because of the nature of a screw thread, bottles in the pockets formed by the thread root tend to tilt forwardly; that is, with the top of the bottle tilted in the direction of advance of the bottle along the length of the screw conveyer. It is undesirable to have the bottles tilted when they encounter the piercing tip of the knife since this can lead to diagonal cuts and a number of associated problems. There is, therefore, a station immediately upstream from the tip of the knife for assuring that the bottles are vertical when they engage the knife.

Figure 6:
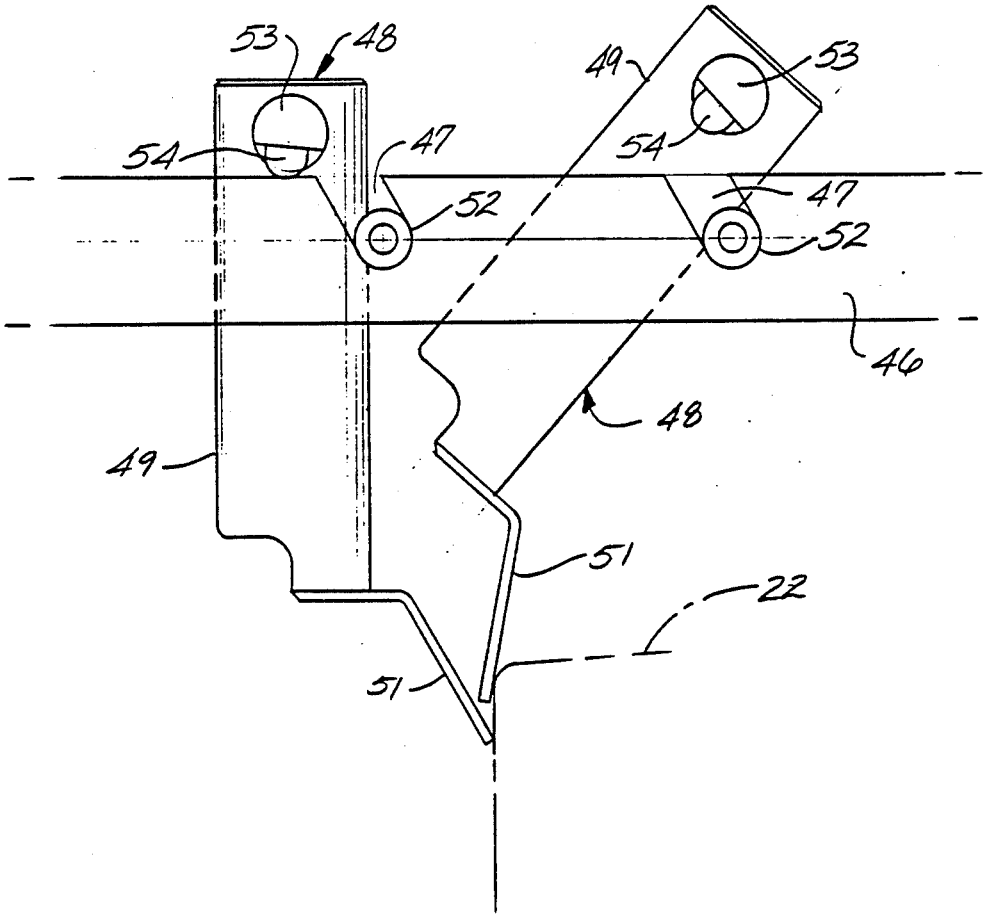
FIG. 6 is a fragmentary detail of a portion of the machine for assuring that the bottles are erect in the cutting station.

The structure for standing the bottles erect is illustrated in a fragmentary side view in FIG. 6 with the surrounding structure deleted. A pair of parallel rails 46 extend parallel to the axes of the screws. A pair of slots 47 are provided in the rails at two locations, one downstream of the other. A pair of similar weights 48 are pivotally mounted in the respective pairs of slots.

Each weight is a cylindrical body 49 of stainless steel. A flat flap 51 is welded on the bottom of the body to extend diagonally in the upstream direction. A pivot pin 52 is welded on the upstream edge of the cylindrical body and extends laterally from the body a couple of centimeters on each side. The ends of the pivot pin are dropped into a pair of slots 47 for supporting the weight for pivoting around an axis eccentric to the center of mass of the weight. A pair of ears 53 with cushioning bumpers 54 extend laterally from each side of the weight near the top. The bumpers land on the tops of the rails when the weight is pivoted down.

As a bottle 22 is moved along the two screws, a top portion of the bottle engages the flap on the upstream weight. This causes the weight to pivot around the pivot pin, tilting it downstream and applying a longitudinal upstream force against the top of the bottle. The longitudinal upstream force counteracts the downstream tilt of the bottle in the screw threads and pushes it erect.

The upstream weight tends to stand the bottle erect, but the complete erection may not have occurred within the distance where the rotating weight remains in engagement with the side of the bottle. The two weights are therefore mounted so that the flap of the downstream weight engages the side of the bottle shortly before the flap of the upstream weight would pass over the top of the bottle. In this way the bottle is handed from one weight to the next. The flap of the downstream weight remains in engagement with the bottle for keeping it erect until the side of the bottle engages the piercing tip of the knife. The downstream weight is positioned so that its flap clears the tip of the blade.

Since the apparatus with a feed screw for moving bottles of plasma through the apparatus is quite simple in construction and is free of a multitude of moving parts it is quite easy to keep clean. As a result microbial contamination of the blood plasma from such a machine is at least an order of magnitude improved as compared with the prior carousel. Weekly averages of from two to ten colony forming units per milliliter have been consistently observed.

Further, the simplicity greatly enhances the reliability of the equipment so that the yield is improved. The yield of the carousel was in the order of 55 to 65% of the full speed capacity. The production rate of the apparatus herein described can routinely exceed 80% of full speed capacity. Further, the full speed capacity is increased more than 50%. These factors combine to more than double the effective production capacity of the bottle cutting and emptying machine.

Not only is the new machine quieter than the prior machine with extensive pneumatics, it is much more energy efficient. The equivalent energy consumption of the prior carousel was over forty horsepower, whereas the new screw conveyor apparatus operates at only two horsepower.

Although one embodiment of bottle cutting and emptying machine has been described and illustrated herein, many modifications and variations will be apparent to one skilled in the art. Thus, for example, although the machine is used for cutting the tops of round bottles in this embodiment, changes in the geometry of the thread on the feed screw can make such a machine useful for rectangular bottles, for example.

The preferred embodiment has the erect bottles essentially vertical. It will be apparent that if desired, essentially the entire apparatus might be tilted away from the wall. In such an embodiment the cutting knife could be aligned with the tilted bottles in the loading section. After cutting, the pivoting of the bottles away from the more or less erect caps need not be as large as when the cutting blade is horizontal. Under some circumstances cutting the bottom of a bottle may be suitable.

The described driving arrangement for a second screw having opposite handed threads from a first screw may also be useful in other contexts. It can be advantageous where the second screw is in an intermediate portion of the first screw where direct drive of both screws in synchronism may be inconvenient and it is undesirable to provide a second driving motor which must be kept in synchronism with the first screw. This can be used where it is desired to pass articles along the screw conveyer, thereby preventing direct geared connection between the two screws. In that context the second screw can be easily driven in synchronism with the first by having interengaging gear teeth on the crests of the opposite handed threads.

The contents of the bottles need not be liquid but may be granular or other particles. For other products a hot wire or other means may be provided for cutting the bottle. Shearing with a sharpened blade is preferred because of absence of decomposition products or particles that might contaminate the contents of the bottle.

Because of such modifications and variations it is to be understood that within the scope of the appended claims the invention may be practiced otherwise than as specifically described.

What is claimed is:

1. A machine for cutting and emptying plastic bottles comprising:

a feed screw for conveying bottles through the machine;

a support screw parallel to the feed screw for supporting the bottles in an erect orientation and preventing collapse of the bottles;

a stationary knife with a fixed horizontal cutting edge above the screws and aligned with the erect bottles below the top for cutting caps off the bottles; and guide means along the feed screw downstream from the knife and downstream from the support screw for at least partly inverting the bottles while in the feed screw and emptying the contents of the bottles.

2. A machine as recited in claim 1 wherein the crests of the threads on the two screws are sufficiently close to each other for preventing a collapsed bottles from squeezing through any clearance between the screws.

3. A machine for cutting and emptying plastic bottles comprising:

a feed screw for conveying bottles through the machine;

a support screw parallel to the feed screw for supporting the bottles in an erect orientation and preventing collapse of the bottles;

a knife above the screws having a fixed horizontal cutting edge aligned with the bottles below the top for cutting caps off the bottles;

interengaging teeth extending along the screws at least one full pitch of the threads on the crests of the threads of the feed screw and support screw;

guide means along the feed screw downstream from the knife and downstream from the support screw for at least partly inverting the bottles in the feed screw and emptying the contents of the bottles.

4. A machine for cutting and emptying plastic bottles comprising:

a feed screw for conveying bottles through the machine;

a support screw parallel to the feed screw for supporting the bottles in an erect orientation and preventing collapse of the bottles;

a stationary bifacial horizontal knife blade having a fixed horizontal cutting edge and an upstream point for piercing the side of a bottle above the screws and aligned with the bottles for cutting caps off the bottles; and guide means downstream from the knife and downstream from the support screw for at least partly inverting the bottles in the feed screw and emptying the contents of the bottles.

5. A machine as recited in claim 4 wherein the knife is asymmetrical for cutting through a major portion of the circumference of the bottle and leaving a minor portion connecting the cap with the balance of the bottle at one side of the bottle.

6. A machine as recited in claim 5 comprising means for pivoting the cap around the connection between the bottle and the cap.

7. A machine for cutting and emptying plastic bottles comprising:

a feed screw for conveying bottles through the machine;

a support screw parallel to the feed screw for supporting the bottles in an erect orientation and preventing collapse of the bottles;

a knife above the screws and aligned with the bottles below the top for cutting caps off the bottles; and guide means along the feed screw downstream from the knife and downstream from the support screw for retaining the bottles in the feed screw and tilting the bottles downwardly and beneath the axis of the screw for at least partly inverting the bottles and emptying the contents of the bottles.

8. A machine as recited in claim 7 wherein the guide means is sufficiently close to the screw to pinch the bottle against the root of the screw thread.

9. A machine as recited in claim 1 comprising a launder downstream from the knife beneath the mouths of the inverted bottle for collecting contents of the bottles.

10. A machine for cutting and emptying plastic bottle comprising:

a feed screw for conveying bottles through the machine;

guide means for retaining the bottles in the feed screw;

a cutting station;

means upstream from the cutting station for standing the bottles erect in the feed screw;

a stationary knife in the cutting station having a fixed horizontal cutting edge aligned with the erect bottles below the top for cutting caps off the bottles;

guide means downstream from the cutting station for at least partly inverting the bottles while in the feed screw and emptying the contents of the bottles;

means for preventing the caps from interfering with emptying the contents of the bottles; and means for discharging empty bottles.

11. A machine as recited in claim 10 comprising a support screw parallel with the feed screw in the cutting station with the crests of the thread on the two screws nearly touching.

12. A machine for cutting and emptying plastic bottles comprising:

a feed screw for conveying bottles through the machine;

a support screw parallel to the feed screw;

a cutting station;

interengaging teeth extending along the screws at least one full pitch of the threads on the crests of the threads of the feed screw and the support screw so that one screw synchronously drives the other screw;

means upstream from the cutting station for standing the bottles erect between the feed screw and the support screw;

a knife in the cutting station aligned with the erect bottles below the top for cutting caps off the bottles;

guide means downstream from the cutting station for at least partly inverting the bottles and emptying the contents of the bottles;

means for preventing the caps from interfering with emptying the contents of the bottles; and means for discharging empty bottles.

13. A machine as recited in claim 10 comprising a support screw parallel with the feed screw in the cutting station with the threads on the two screws defining bottle supporting pockets between the screws.

14. A machine as recited in claim 13 wherein the feed screw and support screw each include interengaging teeth on the crests of the threads extending along the screws at least one full pitch of the threads.

15. A machine for cutting and emptying plastic bottles comprising:

a feed screw for conveying bottles through the machine;

guide means for retaining the bottles in the screw;

a cutting station;

means upstream from the cutting station for standing the bottles erect in the feed screw;

a stationary bifacial horizontal knife blade in the cutting station having a fixed horizontal cutting edge and an upstream point for engaging the side of a bottle below the top for cutting caps off the bottles;

guide means downstream from the cutting station for at least partly inverting the bottles in the feed screw and emptying the contents of the bottles;

means for preventing the caps from interfering with emptying the contents of the bottles; and means for discharging empty bottles.

16. A machine as recited in claim 15 wherein the knife is asymmetrical for cutting through a major portion of the circumference of the bottle and leaving a minor portion connecting the cap with the balance of the bottle at one side of the bottle.

17. A machine as recited in claim 10 wherein the means for preventing the caps from interfering comprises means for pivoting the cap around the connection between the bottle and the cap.

18. A machine as recited in claim 17 wherein the means for pivoting comprises guide means for retaining the cap approximately erect as the bottle is inverted.

19. A machine as recited in claim 10 wherein the means for inverting the bottle comprises guide means for pinching the bottle against the root of the screw thread.

20. A machine for cutting and emptying plastic bottles comprising:

a feed screw for conveying bottles through the machine;

guide means for retaining the bottles in the screw;

a cutting station;

means upstream from the cutting station for standing the bottles erect in the feed screw;

a knife in the cutting station aligned with the erect bottles below the top for cutting caps off the bottles;

guide means downstream from the cutting station for retaining the bottle in the feed screw and tilting the bottle downwardly and beneath the axis of the feed screw for at least partly inverting the bottles in the feed screw and emptying the contents of the bottles;

means for preventing the caps from interfering with emptying the contents of the bottles; and means for discharging empty bottles.

21. A machine as recited in claim 10 wherein the means for standing the bottles erect comprises a weight tilted by the side of a bottle moving through the machine.

22. A machine as recited in claim 21 comprising means for mounting the weight with a pivot eccentrically upstream from the center of mass of the weight.

23. A machine as recited in claim 22 comprising a second launder beneath other portions of the bottles for collecting material from the exterior of the bottles.

24. A machine as recited in claim 10 comprising a launder downstream from the cutting station beneath the mouths of the inverted bottles for collecting contents of the bottles.

25. A machine as recited in claim 10 wherein the means for discharging the bottles comprises a chute beneath the downstream end of the feed screw for catching empty bottles.

* * * * *

UNITED STATES PATENT AND TRADEMARK OFFICE

CERTIFICATE OF CORRECTION

PATENT NO. : 4,944,647

DATED : July 31, 1990

INVENTOR(S) : J.C. Oleson; S.K. Teske; R.F. Iturzaeta; E.E. Langer

It is certified that error appears in the above-identified patent and that said Letters Patent is hereby corrected as shown below:

Column 5, line 67, change "15" to -- 15° --.

Column 6, line 28, after "bottle" insert a period.

Column 7, line 10, after "station" insert a period.

In the Claims:

Column 9, line 63, change "bottles" to -- bottle --.

Column 10, line 9, after "screw" (sec. Occur.) insert --so that the feed screw syncronously drives the support screw: and--.

Column 10, line 59, after "inverted" change "bottle" to -- bottles --.

Column 10, line 60, after "plastic" change "bottle" to -- bottles --.

UNITED STATES PATENT AND TRADEMARK OFFICE

CERTIFICATE OF CORRECTION

PATENT NO. : 4,944,647

DATED : July 31, 1990

INVENTOR(S) : J.C. Oleson; S.K. Teske; R.F. Iturzaeta; E.E. Langer

It is certified that error appears in the above-identified patent and that said Letters Patent is hereby corrected as shown below:

Column 11, line 13, change "thread" to -- threads --.

Column 11, line 48, after "threads" insert -- so that the feed screw synchronously drives the support screw --.

Column 12, line 46, after "machine" insert -- for applying a force to the side of the bottle --.

Signed and Sealed this

Twenty-fifth Day of February, 1992

*Attest:*

HARRY F. MANBECK, JR.

*Attesting Officer*

*Commissioner of Patents and Trademarks*